US006074153A

United States Patent [19]

Allen

[11] Patent Number: 6,074,153

[45] Date of Patent: Jun. 13, 2000

[54] DRILL RODS FEEDING DEVICE

[76] Inventor: Jean-Luc Allen, 118 De La Gare, St-Henri De Lévis, Canada, G0R 3E0

[21] Appl. No.: 08/917,091

[22] Filed: Aug. 25, 1997

[51] Int. Cl.[7] ..... E21B 19/00

[52] U.S. Cl. ..... 414/22.53; 175/85; 414/694

[58] Field of Search ..... 414/745.1, 746.3, 414/22.53, 22.54, 22.55, 22.56, 22.62, 22.63, 22.65, 22.66, 22.67, 22.71, 680, 694, 695.5; 221/236, 225; 175/85, 161, 162; 74/89, 105

[56] References Cited

U.S. PATENT DOCUMENTS

| | | | |
|---|---|---|---|
| 3,430,503 | 3/1969 | Mclaughiln | 74/105 |
| 3,506,075 | 4/1970 | Attebo | 175/85 |
| 3,777,932 | 12/1973 | Matsui et al. | 221/236 |
| 3,909,963 | 10/1975 | Patel | 414/695 |
| 3,913,753 | 10/1975 | Swartz et al. . | |
| 3,978,994 | 9/1976 | Woolslayer . | |
| 3,985,189 | 10/1976 | Jahn et al. | 175/52 |
| 4,728,251 | 3/1988 | Takashima et al. | 414/694 |
| 4,834,195 | 5/1989 | Robinson | 175/52 |
| 4,892,160 | 1/1990 | Schively, Jr. et al. | 414/22.53 |
| 5,366,111 | 11/1994 | Ahn | 221/225 |
| 5,806,613 | 9/1998 | Sparks et al. | 414/22.53 |

*Primary Examiner*—Christopher P. Ellis
*Assistant Examiner*—Gregory A. Morse

[57] ABSTRACT

A drill rod feeding device which stores drilling rods and sorts them before placing them into hands with a hydraulic lock. These hands, when loaded and locked, pivot and position the rods into the axis of a drilling head, maintaining them in position to screw them. When this operation is completed, the hands unlock and continue their course toward a waiting position located at 180° from their starting point upward to allow the movement of the drilling head. The opposite takes place when the rods have to be withdrawn, that is waiting at +180°, movement to the drilling axis, locking, unscrewing of the rod of the drilling head, downward to less 180°, unlocking, capture by a sorter-positioner and storage.

16 Claims, 6 Drawing Sheets

DRILL RODS FEEDING DEVICE

BACKGROUND OF THE INVENTION

This invention relates to storage and handling of drilling rods.

PRIOR ART

Some patents have particularly attracted our attention:

U.S. Pat. No. 4,834,195; Robinson, May 30, 1989: shows a charger of drilling rods equipped with a pair of arms, spaced out, and secured by an open jaw in which two drilling rods (34, 36) are parallel, side by side; there is no storage space and the rod position is obtained by a spring (54) and the balls (52,33).

U.S. Pat. No. 3,978,994; Woolslayer, Sep. 7, 1976: shows a rod holder with pivoting fingers that selects pipes, row by row; there are three lengths of three meters end to end. The positioner (49) is over the pile, and the pipes are piled by a pair of parallel rods (46). A cable system (34) sets the pipes in the axis of the positioner.

U.S. Pat. No. 3,985,189, Jahnke and al., Oct. 12, 1976: shows a system for the manipulation of drilling rods, of a carrousel type of designated case, limited to six rods.

U.S. Pat. No. 3,913,753, Swartz and al., Oct. 21, 1975: illustrates a system for storing and manipulating drilling rods. A cam at 90° with shaft, with a pivot point pushed by a cylinder.

U.S. Pat. No. 4,892,160; Schivley, Jr and al.; Jan. 9, 1990: vertical drilling and carrousel type, with designated bin. A charger (20) contains a hand (26) driven by a jack (22).

OBJECTIVES AND ADVANTAGES

A general objective of the invention is to install, in a semi-continuous way, drill string sections coming from a storage box where from the sections are extracted one by one and mechanically assembled to make a long drill string.

A more precise objective is to install on the storage box a toothed wheel for disentangling coordinated with a toothed wheel for delivery which loads the drill string sections one by one into the hands. These hands when loaded may be locked, pivoting and positioning the string sections along the axis of the drilling head and hold them in position during the screwing. When this operation is completed, the hands can be unlocked and move towards a waiting position located at 180° of their starting point, upward, to allow the movement of the drilling head and, later on, come back to the starting point.

DRAWINGS

In the annexed drawings which illustrate a preferred embodiment of the invention:

DESCRIPTION OF THE INVENTION

Figure 1:
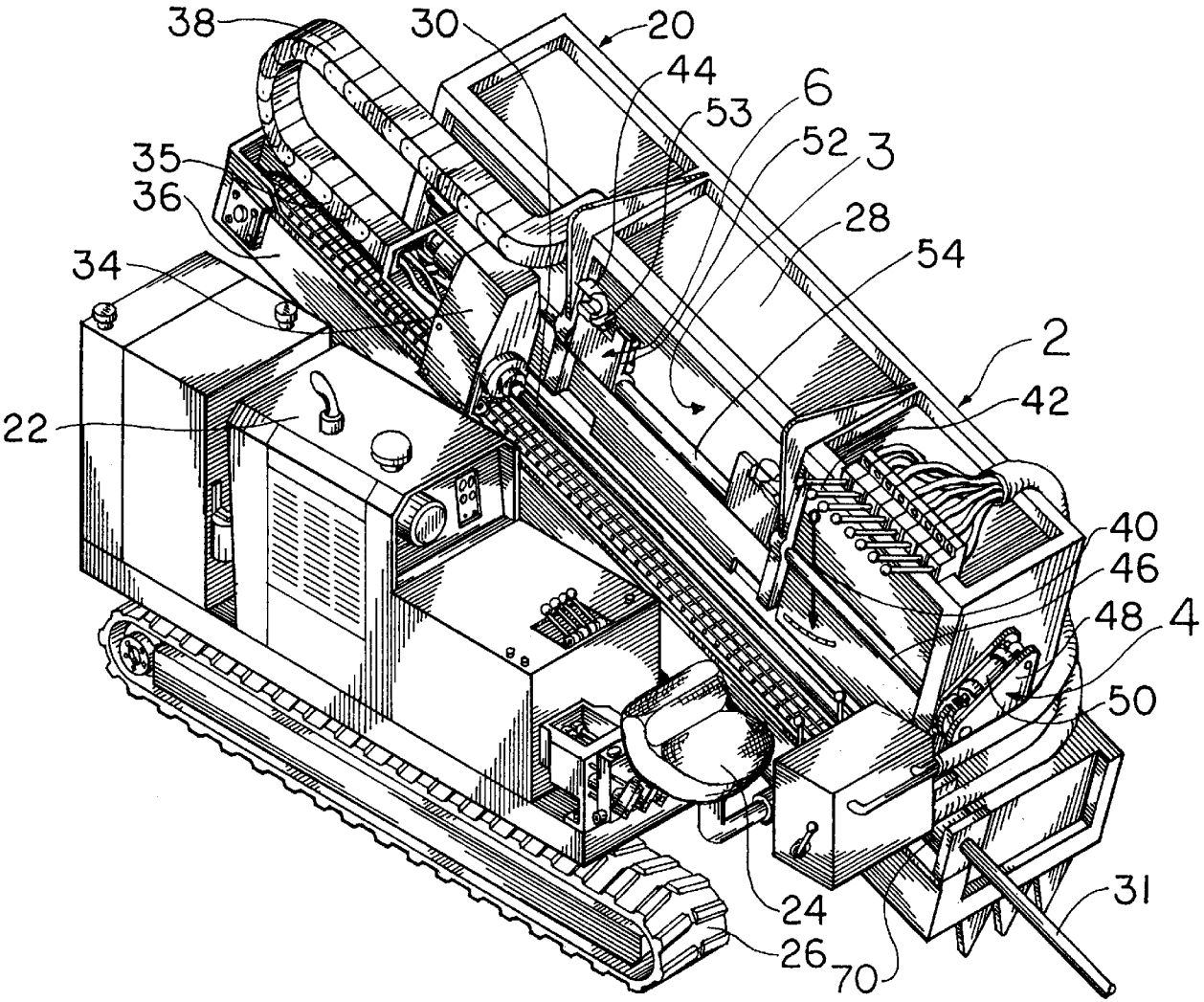
FIG. 1 is a perspective of a drill equipped with the device.

In the description that follows and in the drawings also included similar numbers refer to the identical parts in the varying figures.

Figure 6:
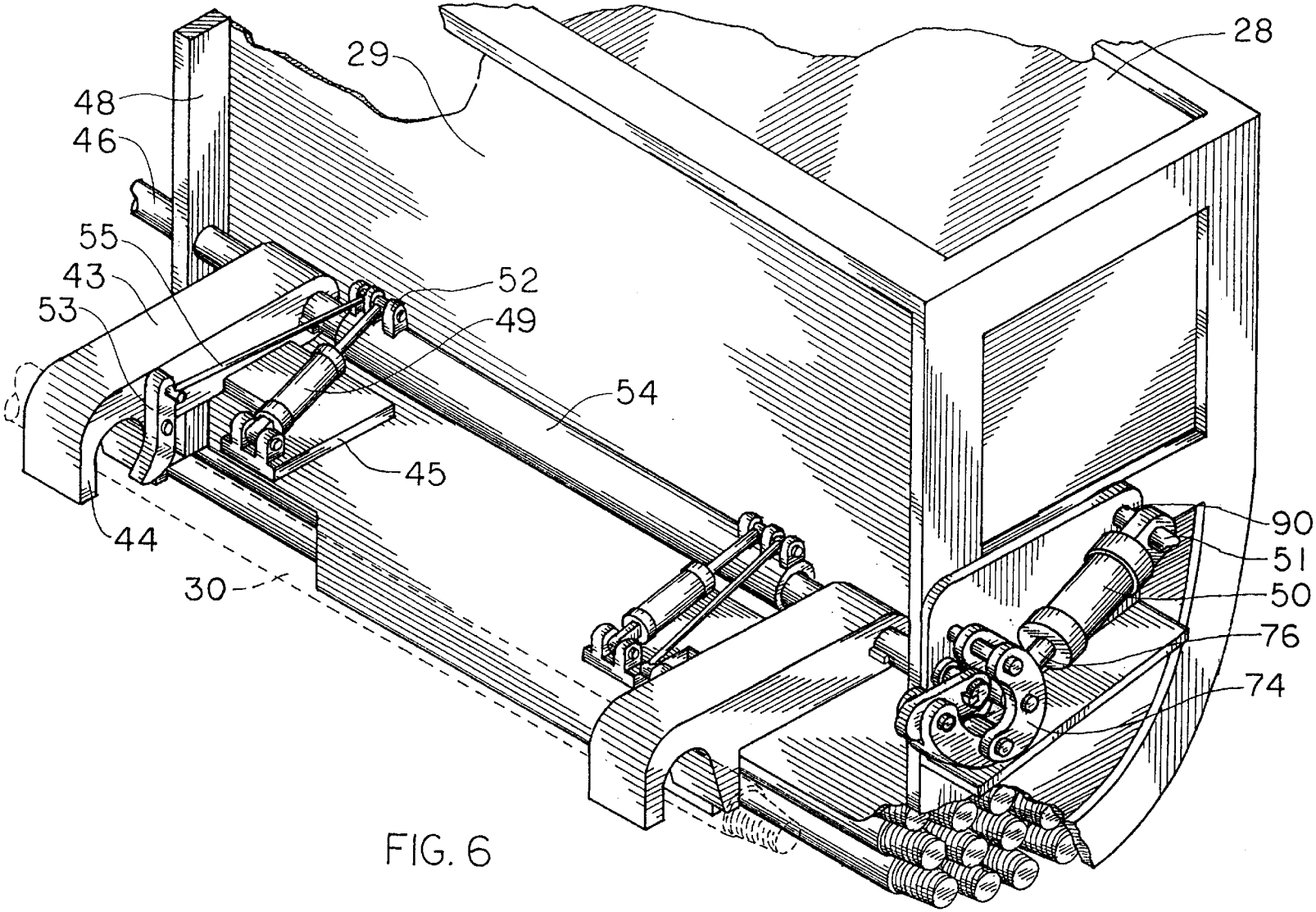
FIG. 6 is a detail view according to arrow 6 of FIG. 1

On the FIG. 1 one sees an horizontal drilling machine, illustrated by an arrow 20 comprising a power unit 22 with an operator's post 24 mounted on a tractor 26, a storage box an magazine 28 for storing sections. Magazine 24 located adjacent to the drilling axis 31 of machine 20. One also sees a drilling head 34 attached to a feeding chain 35 and mounted on a guiding structure 36 for movement along the axis. The drilling head 34 is supplied by hydraulic tubes in a flexible conduit 38. One sees a clinometer 40 and a group of control sticks 42. FIGS. 1 and 6 show a pair of hands 44, a rotation shaft 46 journaled in the frame 48 of magazine 28. A U-shaped hand 44 is formed at the outer end of each arm 43. Shaft 46 is rotated throughout 180 degrees by a rotating device 74 actuated by a double acting hydraulic cylinder 50. A latch lever 53 is pivoted on hand 44 intermediate its ends and is actuated between latching and unlatching positions by a latch lever actuator 52 through a synchronization tube 54 and a link 55.

Actuator 52 is a double acting hydraulic cylinder pivotally mounted on a plate 45 secured to arm 43. Tube 54 freely rotates about shaft 46 and serves to synchronize the latching and unlatching movements of the two latch levers 53.

Figure 2:
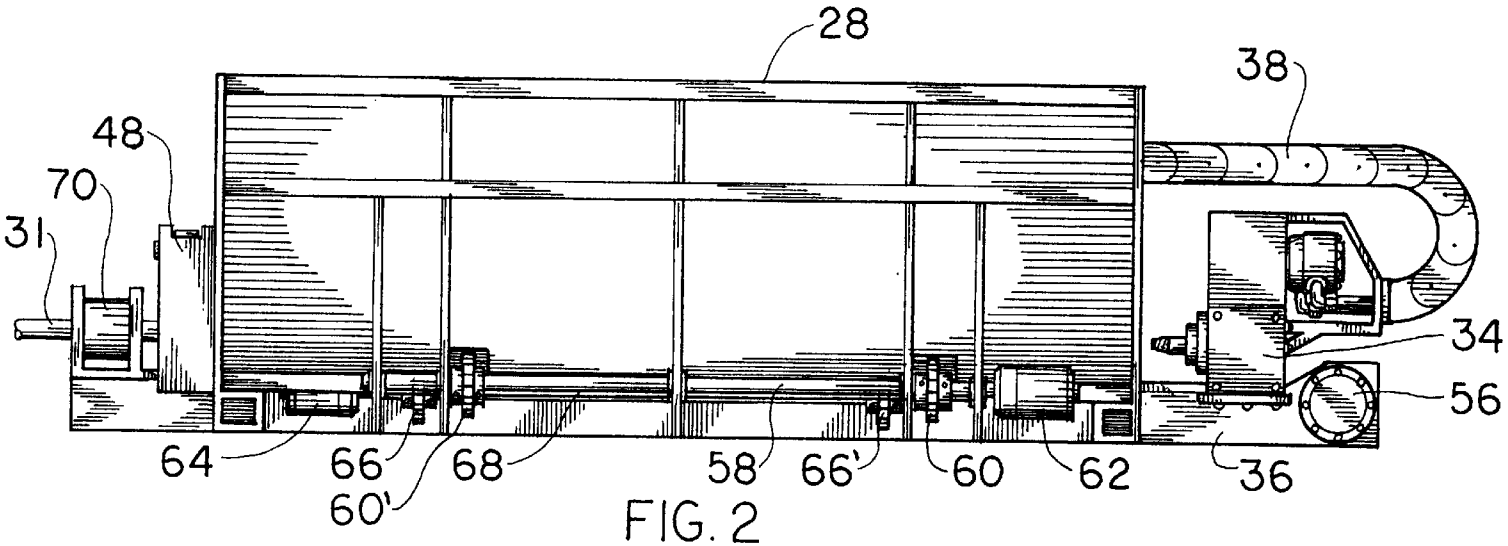
FIG. 2 is a back view according to arrow 2 of FIG. 1

On FIG. 2 one sees a motor 56 to command the feeding chain 35 which is not shown on FIG. 1 which moves the drilling head 34 along axis 31. One also sees a sorter shaft 58 commanding two sorter toothed wheels 60 and driven by a sorter motor 62. One also sees a motor positioner 64 which drives two positioner toothed wheels 66 attached to a shaft positioner 68.

Figure 3:
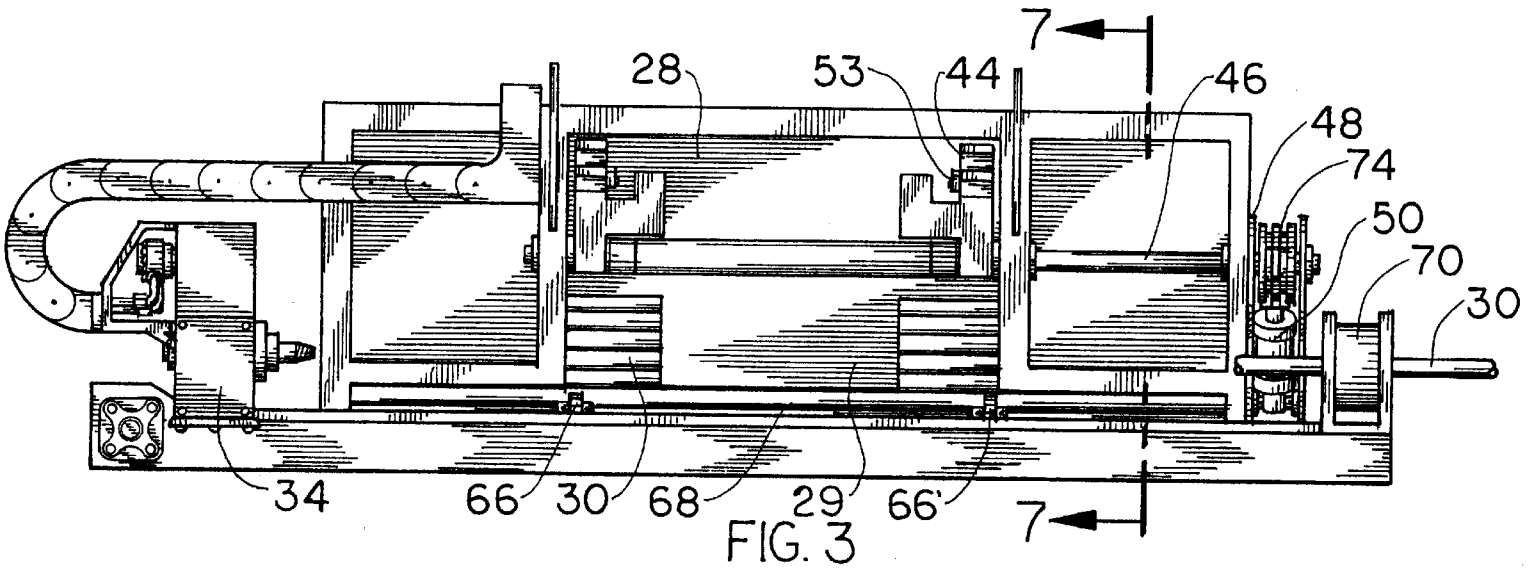
FIG. 3 is a front view according to arrow 3 of FIG. 1

On FIG. 3, one sees the stored drill string sections 72, the pair of hands 44 in elevated position +180°, the latch levers 53 and rotating device 74.

Figure 4:
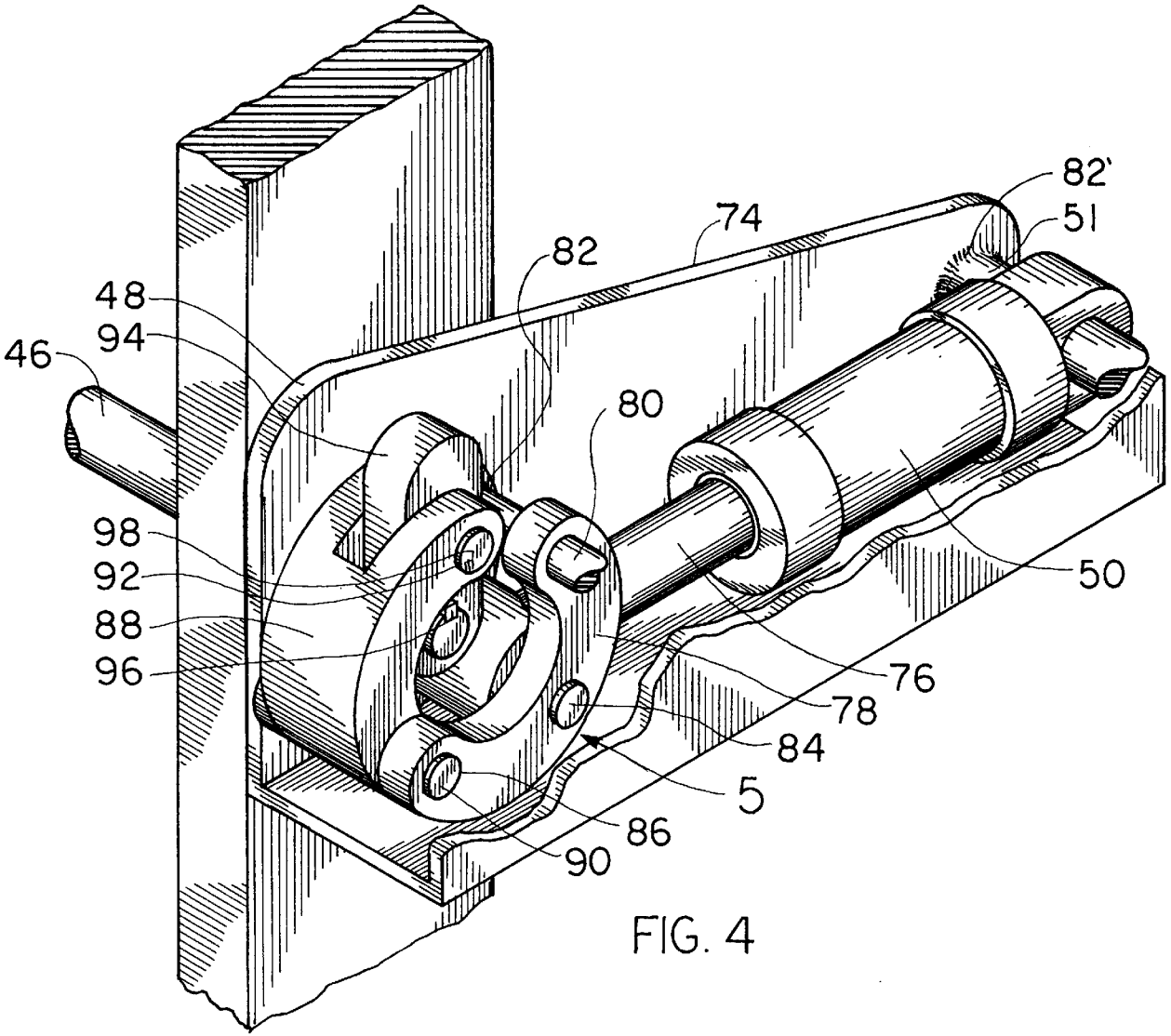
FIG. 4 is an enlarged view of the area of arrow 4 of FIG. 1

On FIG. 4 one sees the rotating device 74 and its components: hydraulic cylinder 50 held by a body pivot 51 welded at 82' on the frame 48, a piston rod 76, a first crescent 78, an upper pivot 80 welded of 82 on the frame 48, an intermediary pivot 84, an inferior pivot 86 an intermediary crescent 88 with a base male pivot 90 integrated with the inferior female pivot 86, an terminal female 92 a lever arm 94 attached to the rotation shaft 46 by a keyway 96 and attached to the intermediary crescent 88 by a pivot pin 98. In FIG. 4 keyway 96 and rod 94 are oriented upward in a position corresponding to the raised portion of the pair of hands 44 shown in FIG. 3 and 7.

Figure 5:
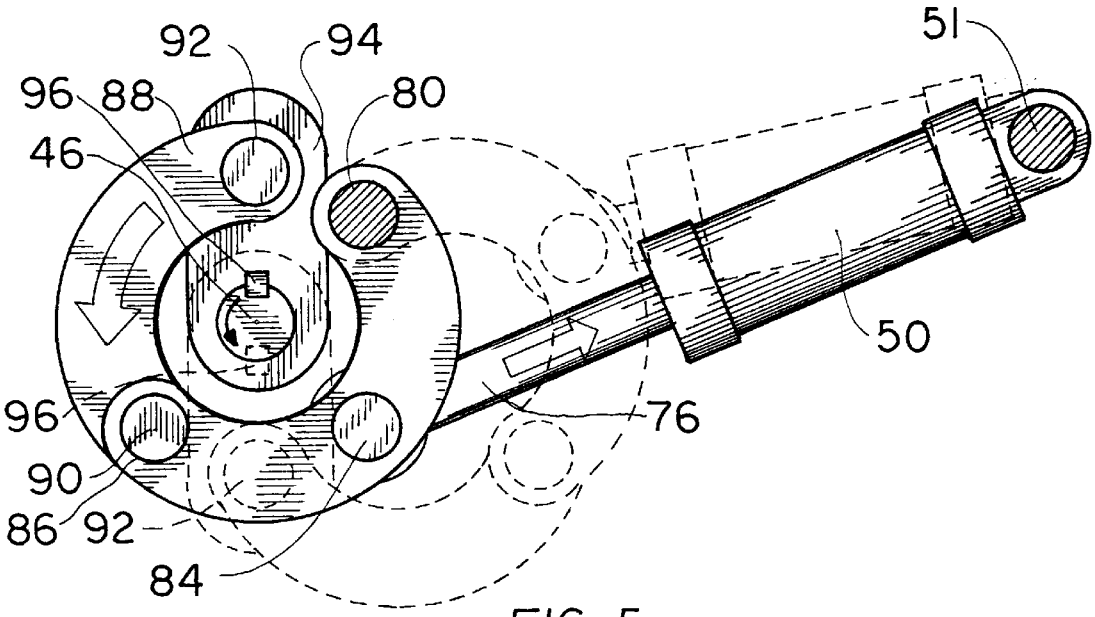
FIG. 5 is a detail according to arrow 5 of FIG. 4 in movement.
Figure 7:
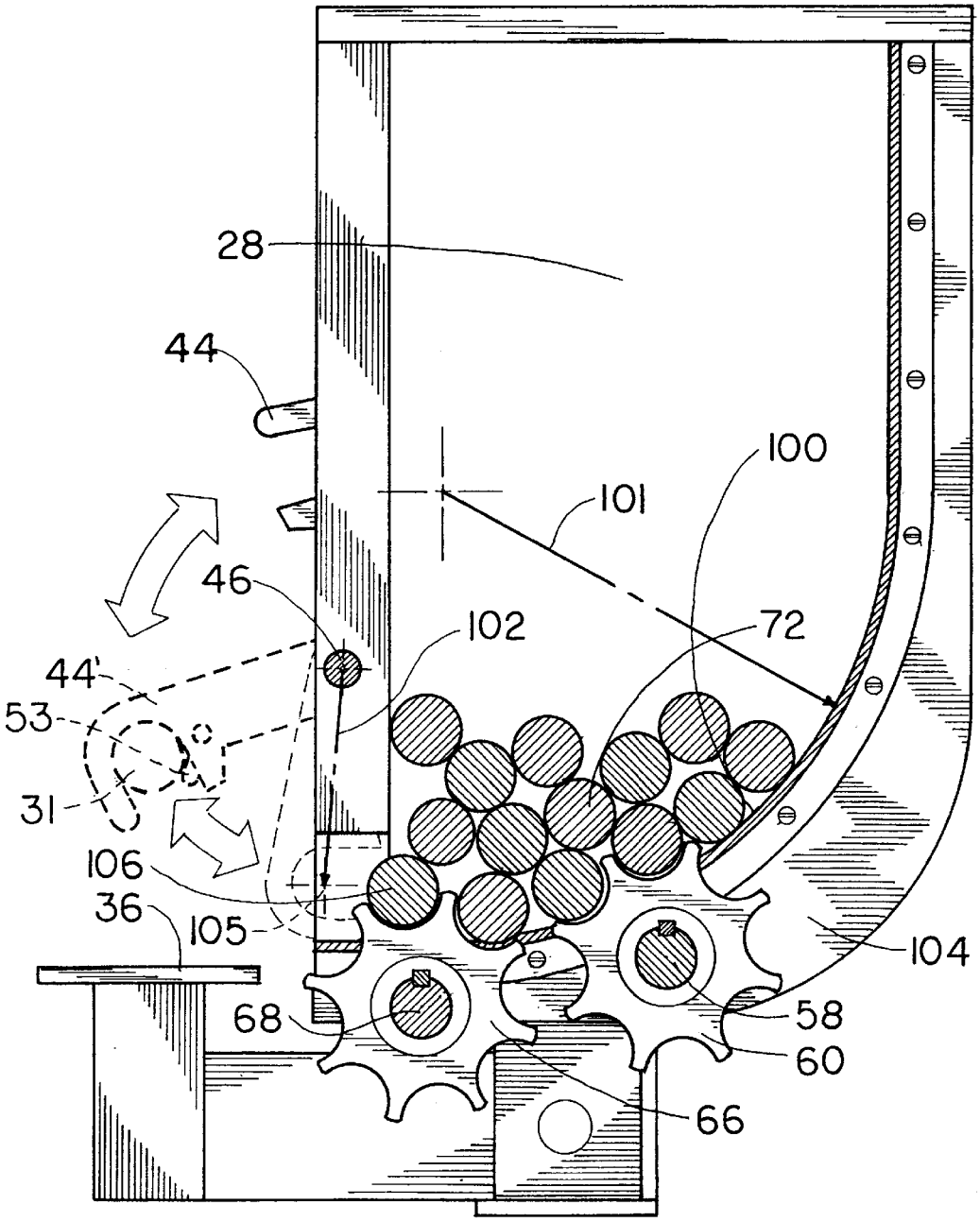
FIG. 7 is a cut view according to line 7—7 of FIG. 3

FIG. 5 shows in full line rotating device 74 in the position of FIG. 4, piston rod 76 being fully extended, and in dotted line piston rod 76 fully retracted with lever arm 94 having rotated through 180 degrees and extending downwards. As shown in FIG. 7, rotation device 74 can rotate hands 44 between a lowermost position and an elevated position, in both these positions, hands 44 clear drilling head 34 during its movement over guiding structure 36 for feeding chain 35.

On FIG. 7 one sees the storage box 28 with a semi-circular bottom 100 with a radius 101: on the bottom are stored the drill string sections 72. One sees a reinforcement plate 104 and an exiting drill string section 106, one of two sorting toothed wheels 60 keyed to the sorter shaft 58, one of the two positioner toothed wheel 66 on a positioner shaft 68; one sees the pair of hands 44 in lowermost pickup position with a displacement radius 102 that defines arm 43 attached to rotation shaft 46. One sees, in dotted line, the pair of hands 44 about to capture an exiting rod section 106 and which is in the position of drilling axis 31 located at about 60 degrees of the exiting section 106. A guiding structure 36 also serves to screw the string section now in the drilling axis. Then the pair of unlatched hands 44 which continue around the rotation shaft 46 to stop in an upper position 37.

SUMMARY AND RAMIFICATIONS

The feeding device for drilling rods 30 which are to be used in a drilling axis 31 comprises:

a storage box 28 comprising a curved bottom, preferably a circular bottom 100, where lay the stored rods 72 disposed in a parallel direction, one on another, the bottom having an opening 105, a sorter toothed wheel 60 capable of orienting the rods in a parallel direction, with circumferential teeth, a positioner toothed wheel 66 capable of withdrawing a rod from the bottom of the storage box and position the rod, by means of engaging teeth, a pair of hands 44, lockable, the positioner toothed wheel 66 positioning the section in the hands when it is appears through the opening 105. The positioner toothed wheel 66 are also capable of taking the section back from the hands 44 and returning it to the sorter toothed wheels 60 which put it back into the storage box and sets it parallel to the stocked drill sections 72.

The bottom wall 100 extends through an arc of preferably 90° and its radius 101 is proportional to the diameter and quantity of sections 72. The proportion is preferably of 10 to 15 times the diameter. The sorter toothed wheel 60 comprises a shaft, two toothed wheels joined to the shaft and synchronized, and acting as two rotating devices located on the face of the curved bottom.

The two positioner wheels are located at opening 105 and are sufficiently distant from the sorter that the circular section body of a drill string section 72 is supported a moment by the teeth of both the sorter toothed wheels 60 positioner toothed wheel 66. The lock is preferably hydraulic.

The place of storage box 28 comprises a bin pivot located it a certain distance above the opening. This bin pivot coincides with the rotation shaft 46, the bin pivot being an eye in the wall of the bin in which the rotation shaft 46 turns.

The pair of hands 44 is capable of moving around the bin pivot, about a radius equal to the distance between this pivot and the drilling axis, so that the pair of hands, when moving, can be placed within the rotation axis of the drilling head, so that the drilling head can be screwed onto a drilling rod while in position.

The objectives of the invention may be effected while using a method of supplying drill string sections 30 in a storage box 28 having an opening 105 at the bottom, the method comprising the following steps:

1° sort the drill string sections,

2° position sections at the opening, one at a time,

3° load in two mechanical pivoted hands a certain distance above the opening,

4° lock the mechanical hands with two latches,

5° move the hands, according to a circular arc, towards a drilling axis,

6° move forward the drilling head,

7° screw the drilling head to the drill string sections,

8° unlock the hands to release the sections,

9° release the latches so that the hand may pursue its angular course upward and places itself of 180° of the storage box opening and the free space for the movement of the drilling head.

The hands are always lifted by the two latches, serving as guide to allow the rotation of the section and the movement of the drilling head, to assure the alignment of the new section and to allow it to join the section already in place in the drilling axis. The drilling axis will preferably be placed at 60° of the opening.

A subsequent step of storage: at the time of the removal of the sections the hands initiate the reversed process: movement from the waiting position +180° toward the drilling axis, locking, unscrewing, movement toward the opening of the storage box to replace the sections.

Means for locking the hands comprise a rigid synchronization tube 54, pivoting freely around a rotation shaft 46 of the hands and assuring a perfect synchronization with the latch guide 53. The rotation shaft 46 serves as support for the synchronization tube 54 of the latch guide 53. The latch guide 53 comprises a hydraulic cylinder body 50, the closure of the latch guide 53 assured by closing rods 55 attached to the synchronization tube 54.

A rotation shaft 46 of the hands on which are placed the hands of the pair of hands 44 according to a precise alignment so that the hands may grab the rods and keep them parallel to the drilling axis 31, the exit axis and the rotation axis of the hands.

The rotation shaft 46 on which are placed the hands transmits the power of the rotation system of the hands through an angular displacement of 180 degrees, that is from the storage box opening to the superior waiting position and vice-versa, passing by the drilling axis to add or withdraw a rod from the drilling axis 31.

The rotating device 74 allows a movement of more than 180 degrees and this without standing still or congestion to prevent any interference with the drilling head. This device assures the rotation of the hand from the opening of the storage box to the waiting position of +180 degrees, passing by the drilling axis of +60 degrees for the installation or the removal of the drilling rods 30.

The rotating device 74 comprises a cylinder body 50 comprising a body pivot 51, a cylinder rod 76, a first crescent 78, an intermediary crescent 88 and a connection rod 94; the cylinder rod 76 protruding from the cylinder body 50, the first crescent 78, in its upper part comprises an upper pivot 80 welded 82 to a fixed point on the structure of the storage box, the cylinder rod 76 being attached to a part of the first crescent 78 by a pin, an upper part of the first crescent 78 being linked to a reaction pivot placed on the structure of the storage box and the lower part of the first crescent being attached at the lower part of the intermediate crescent 88, the upper part of the intermediary crescent 88 being attached to a connection rod 94 joining the rotation shaft 46 of the hands.

The movements in and out of the cylinder rod 76 make the first crescent 78 pivot around the fixed upper pivot 80, the descent of the intermediary crescent 88 and the rotation of the connection rod 94 and of the rotation shaft 46 that are attached to the hands.

What I have described is a device for supplying drill rods 30 to be used in a drilling axis 31, the device comprising:

a storage box 28 for drill rods having an inclined bottom where the drill rods 30 pile up, parallel to each other, and at a certain distance of one another, a sorter shaft 58 equipped with teeth capable of making the rods parallel, a positioner toothed wheel 66 for rods, which grabs the rods and guides them towards an opening 105, a pair of hands 44 pivoting around a pivot axis located at a certain distance, higher than the opening and corresponding to a circle radius. The drilling axis and the storage opening are located on the same circumference.

the pair of hands 44 comprising rotation means up to a position corresponding to the drilling axis and then up to 180 degrees to allow the movement of the drilling head.

It is well intended that the embodiments of the present invention which have been described herein in reference to the joining drawing has been given as indicative and are in no case limitative, and that the modifications and adaptations may be brought without losing sight of the objects of present invention.

Other embodiments are possible and limited only by the scope of the claims that follow:

PARTS LIST

20. horizontal drilling device
22. power unit
24. operator's post
26. tractor
28. storage box
30. drill rod
31. drilling axis
34. drilling head
35. feeding chain
36. guiding structure
37. upper position
38. coupling
40. clinometer
42. control sticks
44. pair of hands
46. rotation shaft
48. frame
50. cylinder body
51. body pivot
52. latch eye
53. latch guide
54. synchronization tube
55. closing rod
56. advancing motor
58. sorter shaft
60. sorter toothed wheel
62. sorter motor
64. positioner motor
66. positioner toothed wheel
68. positioner shaft
70. rod guide.
72. stocked rod
74. rotating device
76. cylinder rod
78. first crescent
80. upper pivot
82. weld
84. intermediary pivot
86. inferior pivot
88. intermediary crescent
90. base pivot
92. extremity pivot
94. connection rod
96. keyway
98. connection rod pivot
100. circular bottom
101. bottom radius
102. radius of displacement
104. reinforcing plaque
105. opening
106. exiting rod

I claim:

1. In a horizontal drilling machine of the type having a drill string guide (70) and a boring head (34) movable towards and away from said guide along a drilling axis (31), a device for storing drill string sections (30) and for feeding and retrieving said drill string sections to and from a position coaxial with said drilling axis and between said guide (70) and said boring head (34), said device comprising a magazine (28) shaped and sized to store several drill string sections in loosely stacked and side by side position, having a front wall (29), a bottom wall (100) downwardly sloping towards said front and defining a discharge opening (105) therewith, a sorter device (58,60) and a positioner device (66,68) in said magazine to successively engage stored sections (72), stored in said magazine, to make said sections parallel to one another and to said front wall and to position said sections one at a time in said discharge opening in a pick-up position, the drill string section (30) in said pick-up position being parallel to and below said drilling axis, a shaft (46) carried by said magazine above said discharge opening and parallel to said drilling axis, a pair of arms (43) spacedly secured to said shaft (46) each forming a hand (44) member at its outer end for partly encircling a drill string section (30), a power actuated latch (53) carried by each hand member for releasably latching a drill string section (30) within said hand member and retaining said section parallel to said drilling axis and a power actuated device (74) for rotating said shaft through about 180 degrees, said shaft rotating said hand members through circular arcs between a lower position to partly encircle a drill string section (30) at said pickup position, an intermediate position holding the drill string section co-axial with said drilling axis (31) and an elevated waiting position, said magazine and said hand members when in said lower and elevated positions clearing said boring head when moving towards and away from said guide (20), said positioner device being reversible to take back a drill string section at said pick-up position and return the same into said magazine.

2. The device of claim 1 wherein said bottom wall 100 is partly circular and parallel to said drilling axis (31) and wherein said sorter device comprises a sorter shaft (58), two sorter longitudinally spaced toothed wheels (60) attached to said sorter shaft and partly protruding within said magazine, thereby adapted to raise and move a stored section (72).

3. The device of claim 2 wherein said positioner device (66,68) comprises a positioner motor (64), a positioner shaft (68) and two positioner toothed wheels (66) located at said discharge opening and distant enough from said sorter device to allow the transport of a said stored section (72) to and from said sorter device.

4. The device of the claim 3 in wherein said stored section (72) is an exiting sections (106) seized by a lockable pair of hands (44), moved to an intermediate position coinciding with said drilling axis (31) and said lockable hands are powered by hydraulic.

5. The device of the claim 1 in which said magazine (28) comprises a handling pivot corresponding to a rotation shaft (46) and located a certain distance from said opening (105) and wherein said pair of hands (44) can move around said handling pivot according to a radius equal to the distance of said handling pivot to said drilling axis (31) so that said hands, during their movement be placed in said drilling axis so a working drilling head (34) may adapt and turn said drill string section (30) about said drilling axis (31).

6. The device of claim 5 wherein said handling pivot comprises a rigid synchronisation tube (54) pivoting freely on said rotation shaft (46), a plate (45) is fixed to said arm (43), a hydraulic latch lever actuator (52) attached to said plate (45) at one end and to the synchronisation tube (54) at the other end, the closing of a latch lever (53) closing one of the hands (44) being assured by a pair of parallel closing links (55) attached to said rigid synchronisation tube (54) and the action of one latch lever actuator (52) closing simultaneously the other one of the hands (44).

7. The device of claim 6 wherein said rotation shaft (46) is precisely aligned with said hands so that said hands may grab said drill string sections and keep them parallel to said working axis of the opening and to the rotation axis of said rotation shaft (46) of said hands.

8. The device of claim 7 wherein said rotation shaft on which are placed said hands transmits the power of the rotation system of the hands on an angular displacement of 180 degrees, that is front the storage box opening to the position of superior waiting and vice-versa, passing by said working axis to add or withdraw a drill string section from said drilling axis.

9. The device of the claim 7 wherein a rotating device (74) allows a movement of 180 degrees and this without standstill or congestion to prevent any interference with said working head, said rotating device comprising a hydraulic body comprising successively a cylinder body (50), a piston rod (76), a first crescent (78), an intermediate crescent (88) and a lever arm (94), said piston rod (76) protruding front said cylinder body (50), said first crescent (78) in an upper pivot (80) being fixed to a structure of said storage box, said piston rod (76) being attached to an intermediate pivot (84) of said first crescent (78) by a pin, an inferior pivot of said first crescent (78) being attached through a base pivot (90) of said intermediary crescent (88), an intermediary pivot (92) of said intermediary crescent (88) being attached to a pivot of the lever arm (94), said lever arm (94) having a keyway (96) attached to the rotation axis of the hands.

10. The device of claim 9 wherein the retraction of said piston rod (76) pivots said first crescent (78) around the upper pivot (80) which is fixed, towards said cylinder body (50), the descent of the intermediary crescent (88) and the rotation of the lever arm (94) and of said hands downwardly, the rotation axis being linked to said hands, the reverse movement of said piston rod (76) causing the rotation of said hands upwardly.

11. A method of feeding drilling drill string sections that are stored in a storage box (28) having a discharge opening (105) at the bottom and two mechanical arms, moving on an arc ending in said opening, said method comprising the following steps:

First: align said drill string sections to be parallel to said opening,

Second: position a drill string section to said opening,

Third: load said drill string section in said mechanical hands of said arms,

Fourth: lock said mechanical hands with two latches,

Fifth: move said hands upward to a drilling axis located on said arc,

Sixth: move forward a drilling head toward said drill string section,

Seventh: screw said drilling head to said drill string section,

Eighth: unlock said hands to free said drill string section,

Ninth: moving said arms further upward and positioning them at +180 degrees of said opening of said storage box to free space for the movement of said drilling head.

12. The method of claim 11 comprising a subsequent tenth step: moving said hands from the position at 180 degrees down to the drilling axis, locking the hands, unscrewing the drilling head from said drill string section (30), moving the hands towards the position at the discharge opening of the storage box to deposit said drill string sections into the opening, thereby executing the reverse process.

13. A feeding device for drill string sections (30) which are to be used in a drilling axis, said device comprising:

a storage box for drill string sections having a inclined bottom where the drill string sections are stored, parallel and generally horizontally, a sorter located in said inclined bottom equipped of teeth capable of orienting said drill string sections in a parallel direction, upon their return in said box, a positioner toothed wheel which grabs said drill string sections and guides them towards an opening, two hands pivoting around a pivot axis located a certain distance higher than said opening, corresponding to a circle radius of which the drilling axis and the opening of storage box are on the same circumference, said hands comprising a rotation means for rotating the hands to a position corresponding to said drilling axis and that continues to 180 degrees to allow a clearance for the movement of a drilling head.

14. The feeding device of claim 13 wherein said rotation means comprise a rotating device (74) of two arms attached to a rotation shaft (46) so it can turn said two arms on a circle arc of 180 degrees and come back to −180 degrees towards an initial point, said rotating device (74) comprising:

a jack, pneumatic, hydraulic or electrical, comprising a cylinder body (50) having a base that fixes it in a pivoting way to a structure and a piston rod (76) protruding from said body and possessing a male clevis, a first crescent (78) comprising three pivot points of which an upper pivot (80) is fixed, such as by a weld (82), in a suitable area of said structure (48), an intermediate pivot (84) receiving said male clevis and an inferior female pivot (86) free to move according to the action of said piston rod (76) on said first crescent (78), said three pivot points defining a first circle arc, an intermediate crescent (88) comprising two pivots of which a base pivot (90) and an extremity pivot (92), that has a roundish shape generally convergent with said first circle arc, said base pivot (90) being attached to said inferior female pivot (86), a lever arm (94) protruding in pair from said rotation shaft (46), said lever arm (94) comprising a pivot pin (98) destined to be joined to said extremity pivot (92), the sum of distances between said pivots of said intermediate crescent (88) and the length of torque arms being defined by the position of said pivot pin (98), being longer than the distance between said upper (80) and inferior (86) pivot points of said first crescent (78), a thrust of said piston rod (76) causing an angular movement of said inferior female pivot (86) around said fixed upper pivot (80), said inferior female pivot (86) pushing said intermediary crescent (88) around said shaft and said extremity pivot (92) causing said pivot pin (98) to rotate said rotation shaft (46) 180 degrees.

15. The device of claim 2 wherein said partly circular bottom (100) is defining a circle arc of 90 degrees and its radius is proportional to the diameter and/or quantity of said drill string sections.

16. The device of claim 15 wherein said proportion is of 10 to 15 times said diameter.

* * * * *